United States Patent [19]

Nishioka

[11] Patent Number: 4,797,705

[45] Date of Patent: Jan. 10, 1989

[54] IMAGE FORMING APPARATUS HAVING A HIGH-VOLTAGE UNIT MALFUNCTION DETECTING FUNCTION

[75] Inventor: Nobuaki Nishioka, Toyokawa, Japan

[73] Assignee: Minolta Camera Kabushiki Kaisha, Osaka, Japan

[21] Appl. No.: 10,476

[22] Filed: Feb. 3, 1987

[30] Foreign Application Priority Data

Feb. 4, 1986 [JP] Japan ..... 61-22767

[51] Int. Cl.[4] ..... G03G 15/00

[52] U.S. Cl. ..... 355/14 CH; 355/3 CH; 355/14 R; 355/14 TR

[58] Field of Search ..... 355/3 CH, 14 CH, 14 D, 355/3 TR, 14 E, 14 TR, 3 DD, 3 R, 14 R

[56] References Cited

U.S. PATENT DOCUMENTS 4,286,036 8/1981 Hendriksma ..... 355/3 CH X
4,313,671 2/1982 Kuru ..... 355/3 DD X
4,372,672 2/1983 Pries ..... 355/14 D X
4,377,338 3/1983 Ernst ..... 355/14 D
4,502,778 3/1985 Dodge et al. ..... 355/14 D X
4,571,068 2/1986 Tarumi et al. ..... 355/3 DD X

*Primary Examiner*—Arthur T. Grimley
*Assistant Examiner*—Ed Pipala
*Attorney, Agent, or Firm*—Burns, Doane, Swecker & Mathis

[57] ABSTRACT

An image forming apparatus includes a rotatable photosensitive member and is adpated to form an image on a paper by steps of charging the photosensitive member with a main charger, exposing to form an electrostatic latent image, developing the latent image with a toner, transferring the toner image to a paper with transferring charger. Furthermore the apparatus includes a sensor to detect the amount of the toner adhering to the photosensitive member or to the paper so as to detect a malfunction in the main charger or in the transferring charger.

13 Claims, 4 Drawing Sheets

IMAGE FORMING APPARATUS HAVING A HIGH-VOLTAGE UNIT MALFUNCTION DETECTING FUNCTION

BACKGROUND OF THE INVENTION

The present invention is concerned with an image forming apparatus of the type wherein toner images are transferred to copy paper electrostatically.

Such apparatus usually comprise a rotatable photosensitive member and are adapted to form images on paper by the steps of charging the surface of the photosensitive member, exposing the charged surface to an optical image to form an electrostatic latent image on the surface, developing the latent image with a toner, transferring the toner image to copy paper, removing the remaining surface charge from the photosensitive member and cleaning the member.

Of these steps, the charging step and the transferring step, wherein static electricity is generated, are performed by a charging unit and a transfer unit each comprising a wire electrode. When a high voltage is applied to these units from a high-voltage source connected thereto, the wire electrodes generate static electricity through corona discharge.

However, the wire electrode is likely to deteriorate owing to soiling with toner or corrosion, or to break owing to a paper jam. If the wire electrode breaks, causing short-circuiting, a great current flows and is therefore very hazardous. To eliminate the hazard, the high-voltage source is usually provided with a short detecting circuit for bringing the voltage source out of operation upon detecting short-circuiting.

While many of the apparatus of the type mentioned are sequentially controlled by a microprocessor, the operation of the short detecting circuit is monitored by the microprocessor at all times. For example, the processor judges whether a particular short is due to a break of the wire electrode, whereupon a signal is produced to indicate whether the electrode has broken (Japanese Laid-Open Patent Application No. 54-21727).

Thus, the system including the high-voltage source (hereinafter referred to as a "high-voltage unit" since the system is generally in the form of a unit) must be provided with the short detecting circuit, and further with a "break" indicating signal output means for which a greatly different voltage value is used, when the apparatus is under the control of a microprocessor. The high-voltage unit itself therefore requires an increased cost.

The short detecting circuit detects a break of the wire electrode only when the broken electrode contacts a conductor to cause short-circuiting, and is unable to function otherwise, for example, in the event of a mere break (without the contact of the electrode with a conductor). In the latter case, the copy discharged from the apparatus usually indicates the trouble to the operator, whereas the apparatus is sometimes operated in the absence of the operator. In view of these situations, it is desired to provide a system which is basically adapted to detect the troubles in the overall high-voltage unit including the break of the wire electrode, etc.

SUMMARY OF THE INVENTION

Accordingly, the main object of the present invention is to provide an image forming apparatus which includes a high-voltage unit of reduced cost and which is adapted to detect troubles or malfunctions in the high-voltage unit without necessitating an increased cost.

Another object of the invention is to provide an image forming apparatus adapted to detect malfunctions of its charging system without an increased cost.

Another object of the invention is to provide an image forming apparatus adapted to detect malfunctions of its transfer system without an increased cost.

These and other objects are achieved by an image forming apparatus which comprises a photosensitive member, means for charging the photosensitive member, means for forming an electrostatic latent image on the photosensitive member charged by the charging means, reversal development means for developing the latent image with a toner of the same polarity as the latent image, means for transferring the tone image from the photosensitive member to copy paper, a sensor for detecting the state of the toner image formed on the photosensitive member or on the copy paper, and means for detecting a malfunction in the charging means or the transferring means based on an output from the sensor.

More specifically, when the sensor is disposed downstream from the transferring means and opposed to the surface of the photosensitive member, the sensor detects the amount of toner present in the area of the photosensitive member from which the toner image has been transferred to copy paper. The amount of toner, if large, indicates a malfunction in the transferring means. On the other hand, the sensor detects the amount of toner present in the other area of the photosensitive member. The amount of toner, if large, indicates a malfunction in the charging means.

When the sensor is so disposed as to oppose the copy paper having the toner image transferred thereto, the sensor detects the amount of toner of a reference toner image transferred thereto. If a small amount of toner is detected, this indicates a malfunction in the transferring means. On the other hand, the sensor detects the amount of toner present on the paper in an area thereof having no image transferred thereto. The amount of toner, when large, indicates a malfunction of the charging means.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE INVENTION

The present invention will be described below with reference to the embodiments shown in the accompanying drawings.

Figure 1:
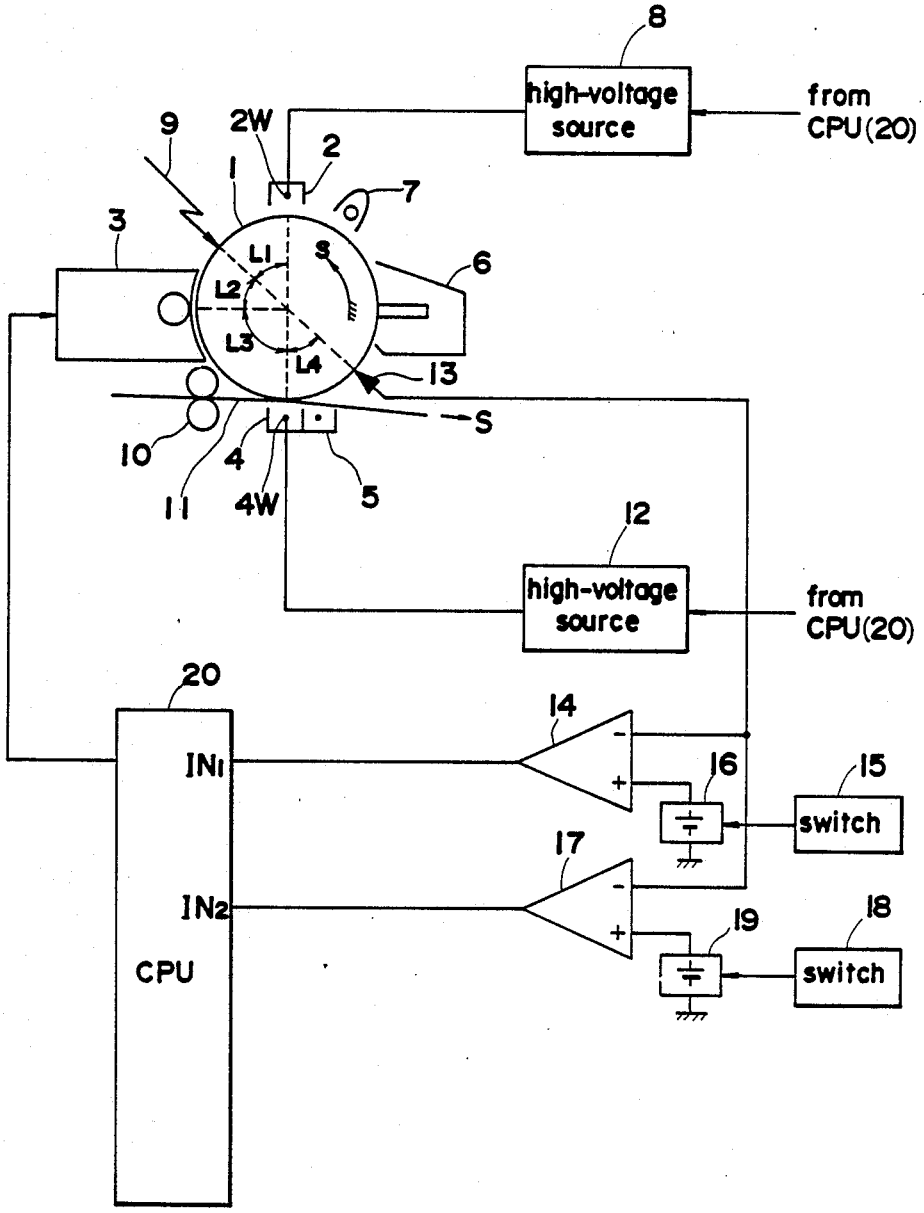
FIG. 1 is a fragmentary diagram showing a first embodiment of the invention.

FIG. 1 shows the main portion of an image forming apparatus embodying the invention. A photosensitive drum 1 is rotatable counterclockwise in the drawing. Arranged around the drum 1 are a charging unit 2, developing unit 3, transfer unit 4, separating unit 5, cleaner 6 and erase lamp 7. These components are in a specified arrangement and are sequentially controlled by a microcomputer (hereinafter referred to as "CPU") 20.

The photosensitive drum 1 is drivingly rotated counterclockwise at a system speed of S mm/s. When the CPU 20 starts up a high-voltage unit 8, a high voltage charging output Vo is applied to a wire electrode 2W of the charging unit 2, which in turn uniformly charges the drum 1. The drum 1 is exposed to a laser beam or like light 9 having image data, whereby an electrostatic latent image is formed on the drum 1. The latent image is then converted to a toner image by the developing unit 3. The present apparatus conducts reversal development by depositing a toner on the photosensitive surface only in the area thereof on which the light 9 impinges. The toner is charged to the same polarity as the latent image. The toner image is transferred on the transfer unit 4 to paper 11 which is transported at the system speed S mm/s by being forwarded by a timing roller 10 driven in timed relation with the exposure of the drum 1. More specifically, the CPU 20 causes a high-voltage unit 12 to apply a high voltage V1 to a wire electrode 4W of the transfer unit 4, which produces static electricity for attracting the toner image onto the paper 11. The paper 11 bearing the transferred toner image thereon is separated from the drum 1 by the separating unit 5. The toner remaining on the drum 1 is scraped off by the cleaner 6. The residual charges are erased by being illuminated by the eraser lamp 7. The image forming cycle described is repeated.

Figure 2:
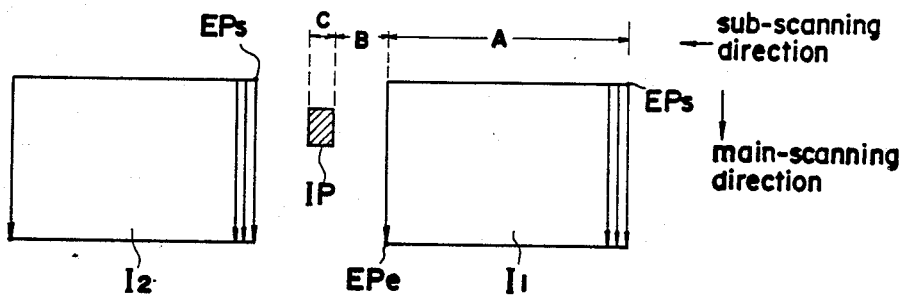
FIG. 2 is a diagram illustrating an AIDC pattern used in the first embodiment.

Interposed between the transfer unit 4 and the cleaner 6 is a photosensor 13 for adjusting the density of copy images. The photosensor 13 comprises a projector for projecting light on the drum 1 and a photodetector for receiving the light reflected from the drum 1. The output of the photodetector is fed to the CPU 20 via a voltage comparator 14. FIG. 2 shows an image area I1 extending from an exposure start point EPs to an exposure end point EPe. The sensor 13 detects the density of an image pattern IP (hereinafter referred to as an "AIDC (auto image density control) pattern") formed at a position a distance B away from the terminating end of the image area I1 in the direction of sub-scanning.

More specifically, with timing following completion of formations of the latent copy image and corresponding to the distance B from the terminating end of the image area in the sub-scanning direction, the AIDC pattern (latent image) is written on the drum 1 by the projection of light 9 controlled by the CPU 20 itself. The sensor 13 detects the density of the AIDC pattern as converted to a toner image on the drum 1 by the developing unit 3. As seen in FIG. 1, the detection signal is fed to an inverted input port of the voltage comparator 14. A reference voltage 16, which is changeable by a density setting switch 15, is fed to a non-inverted input port of the comparator 14. If the density detection signal is not in conformity with the set condition, the comparator 14 delivers to an input port IN1 of the CPU 20 a signal indicating that the density is not appropriate. In response to this signal, the CPU 20 sends a control signal, for example, to a toner supply motor (not shown) incorporated in the developing unit 3 so as to give a proper image density. In this way, the image density is automatically controlled to a value set by the switch 15.

According to the present invention, the operation of the charging unit 2 and the high-voltage unit 8 therefor is monitored utilizing the output of the photosensor 13. Provided for this purpose are a voltage comparator 17 and a reference voltage 19 which is selectively changeable by a switch 18 as seen in FIG. 1. The output of the photosensor 13 is fed to an inverted input port of the comparator 17 and is compared with the reference voltage 19 applied to a non-inverted input port of the comparator 17. When the output is not in conformity with the set condition, the comparator 17 gives an abnormality signal to an input port IN2 of the CPU 20. For example, if the charging unit 2 totally fails to operate, the toner will be solidly deposited on the drum 1 by reversal development. This is detected with timing different from the AIDC pattern detecting timing. A high density, thus detected, can be interpreted as indicating the failure of the charging unit. Further when the charging unit is checked systematically at different reference voltage levels 19 as selected by the switch 18, it is possible to detect deterioration or faulty connection of the wire electrode 2W or faulty connection of terminals.

Figure 3:
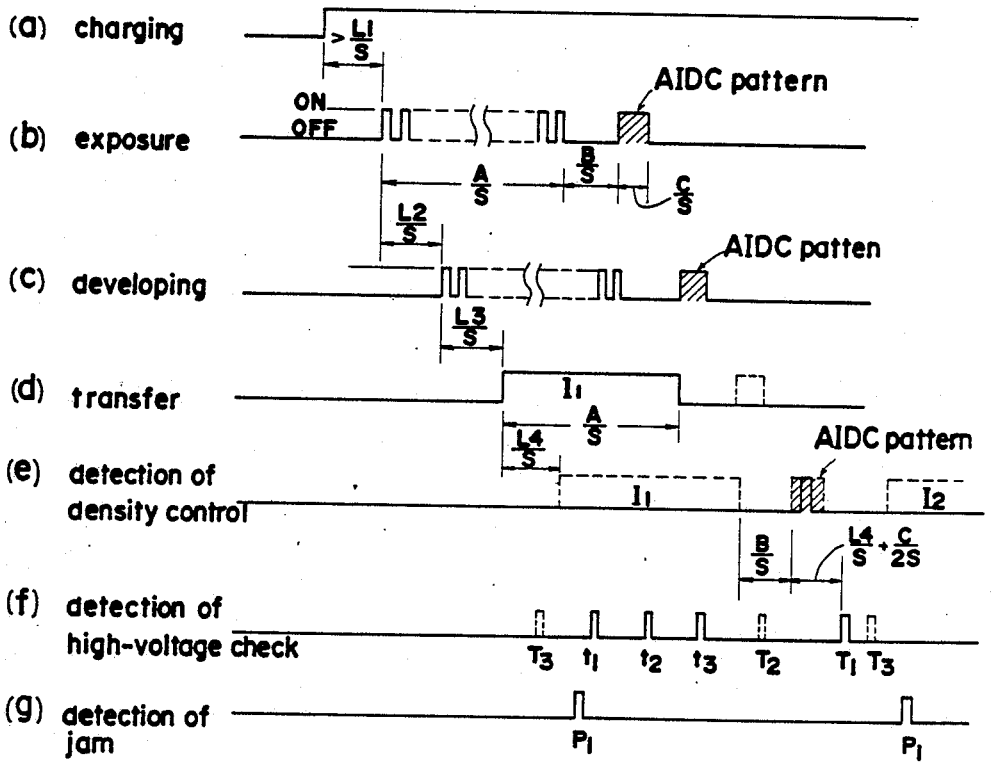
FIG. 3 is a time chart illustrating the timing for a microcomputer to accept data according to the first embodiment.

The CPU 20 controls the timing for accepting the signal from the voltage comparator 17, i.e. the data at the input port IN2. FIG. 3 shows this timing as associated with the image forming process. The symbols L1 to L4 in the diagram represent distances along the outer periphery of the photosensitive drum 1. The distance from the charging position to the exposure position is represented by L1, the distance from the exposure position to the developing position by L2, the distance from the developing position to the transfer position by L3, and the distance from the transfer position to the position of detection by the photosensor 13 by L4. The length of the image formed is represented by A, the distance between the rear end of the image and the AIDC pattern IP by B, and the length of the pattern IP by C.

With reference to FIG. 3, (e), the photosensor 13 detects the density of the AIDC pattern IP at the center of the pattern. In this case, the CPU 20 accepts the data at the input port IN1, $(L2+L3+L4+C/2)S$ after the exposure timing of the pattern. For a better understanding, FIG. 3, (f) and (g) are in coincidence with FIG. 3, (e) with respect to the time axis. For checking the high-voltage unit, especially the charging unit, the CPu 20 accepts the data at the port IN2 a period of time $(L2+L3+L4+C)S$ after the above exposure timing but before the next image I2 reaches the position of detection, namely, at time T1 or T3. This timing can be optional insofar as it is not in coincidence with the AIDC pattern, and may therefore be time T2 that is a period of time $(L2+L3+L4)S$ after the image I1 has passed the detecting position, i.e. after the completion of image projection, as also shown in FIG. 3, (f).

The transfer unit is checked for operation with sampling timings t1 to t3 shown in FIG. 3, (f). The photosensitive member is sampled, for example, thus three times, at the image area thereof from which the image has been transferred to check whether the toner remains in the area even if slightly. When a low density is discernible from all items of the sampling data, this indicates an impaired transfer efficiency of the transfer unit. The reference voltage 19 is of course set to an appropriate value by the switch 18.

FIG. 3, (g) shows the timing for checking the photosensitive drum 1 for the winding of paper therearound, i.e. paper jam, further utilizing the AIDC pattern density detecting sensor 13. The sensor 13 detects the surface density of the drum 1 in the image bearing area thereof. In the absence of paper jam, the toner is completely transferred, rendering the drum 1 nearly mirror-surfaced at the point of detection, whereas the detection point is covered with paper in the event of paper jam. This difference is utilized for the detection of paper jam. Another voltage comparator different from the comparator 17 is of course used for this purpose.

Figure 4:
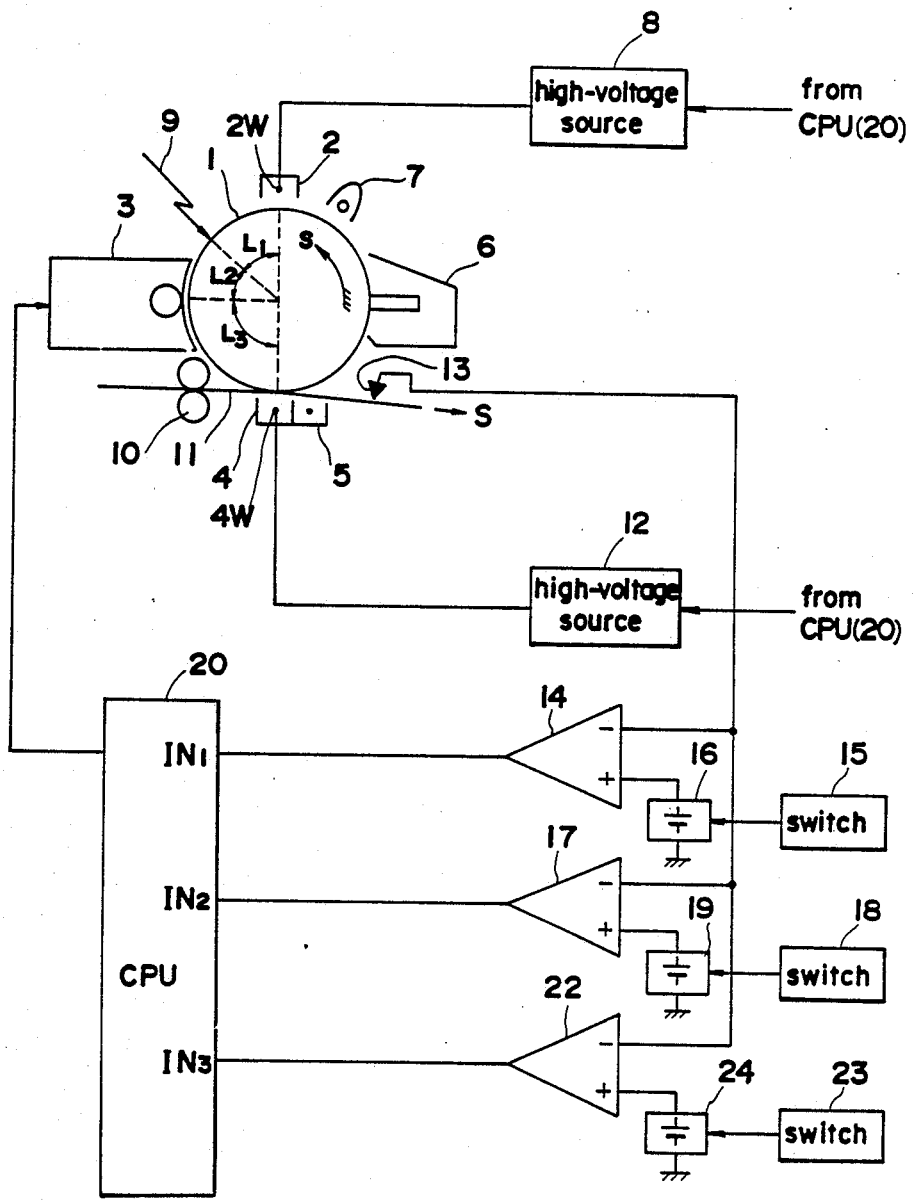
FIG. 4 is a fragmentary diagram showing a second embodiment of the invention.
Figure 5:
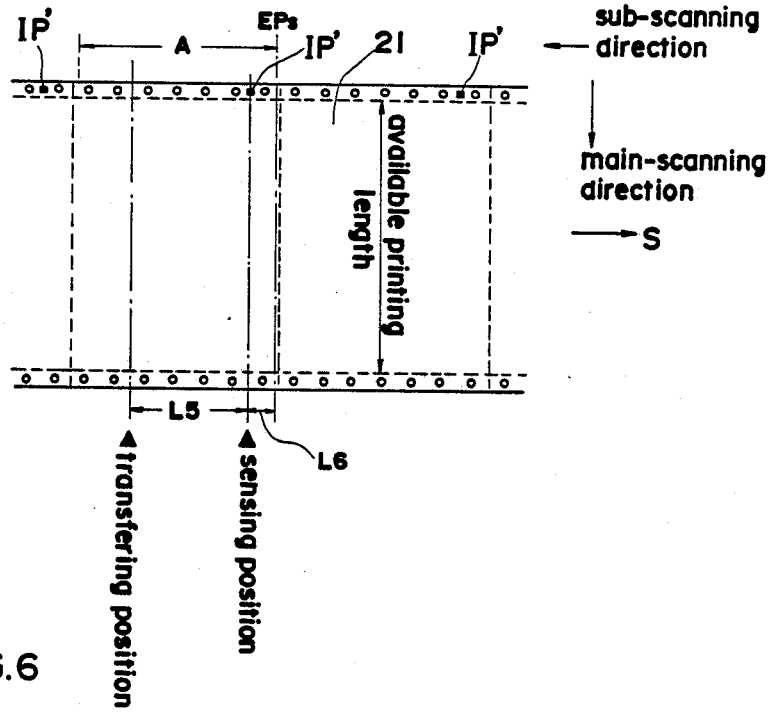
FIG. 5 is a diagram illustrating an AIDC pattern for use in the second embodiment.
Figure 6:
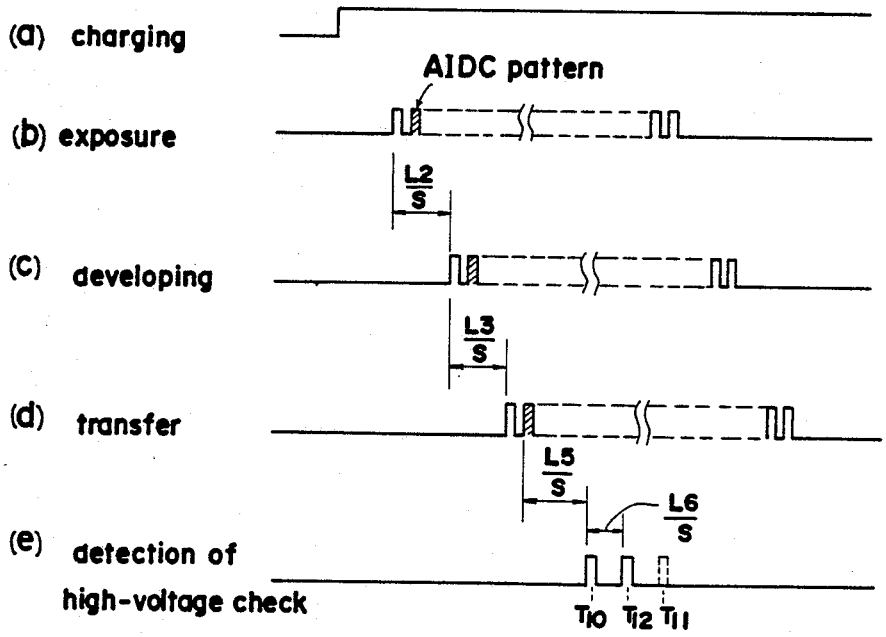
FIG. 6 is a time chart illustrating the timing for a microcomputer to accept data according to the second embodiment.

FIGS. 4 to 6 show another embodiment. Unlike the foregoing embodiment wherein the density of the AIDC pattern on the photosensitive drum is detected, there is a system wherein a photosensor is adapted to detect the density of an AIDC pattern IP' printed on a continuous sheet of paper 21 in an area thereof outside the available printing length. This arrangement shown in FIG. 4 is substantially thus adapted. Throughout the drawings showing the first and second embodiments, like parts are designated by like reference numerals and will not be described repeatedly.

A voltage comparator 22 for detecting a malfunction of the transfer system has an inverted input port, to which the output of a photosensor 13 is fed. A reference voltage 24, which is selectively changeable by a switch 23, is applied to a non-inverted input port of the comparator 22. The comparator 22 feeds an output to an input port IN3 of the CPU 20. The voltage comparator 22 is used exclusively for detecting the malfunctioning of the transfer unit, and the reference voltage 24 differs from the referenced voltage 19 for the charging unit in voltage range and is at such a level as to satisfactorily detect even low densities. The CPU 20 controls the timing for the input port IN3 to accept the input data.

FIG. 6 is a time chart showing the accepting timing. L5 represents the distance between the transfer position of the transfer unit 4 and the position of detection by the photosensor 13, and L6 the distance between the exposure start point EPs and the center of the AIDC pattern IP'. With reference to FIG. 6, (e), the photosensor detects the density of the AIDC pattern a period of time (L2+L3+L5+L6)/S after the start of projection of the image. Approximately with the same timing T12, the CPU 20 accepts via the input port IN3 the data as to the transfer unit. The CPU 20 so controls that the input port IN2 accepts the data as to the charging unit at time T10, a period of time L6/S preceding time T12, or at later time T11.

In accordance with a control program already incorporated in the CPU 20, the CPU gives the acceptance timing at each input port. The data accepted is used for turning on an alarm display or for displaying a message, and for effecting control for treating the malfunction of the charging unit or the transfer unit.

Examples of trouble or malfunction treating procedures include deenergizing the malfunctioning portion, turning off the power supply for the apparatus upon discharge or paper, turning off the power supply upon detecting a malfunction, etc.

The detection of the density of the AIDC pattern, the detection of density for checking the charging unit and the detection of density for checking the transfer unit are conducted at individually different detection levels, so that different voltage comparators are used (or the reference voltage is selectively changed for comparison) according to the foregoing embodiments. However, the output of the photosensor 13 may be converted to a digital signal of a plurality of bits by an A/D converter and then fed to an input port of the CPU 20. Further if the CPU is of the type incorporating an A/D converter, the output of the photosensor 13 may be delivered directly to an analog input port of the CPU. The CPU then controls the timing for accepting the data through the single input port, compares the accepted data with present data and executes a predetermined control process in accordance with the result of comparison.

Further when the data to be compared is changed every time data is accepted, it is possible to establish whether a particular malfunction of the charging unit or the transfer unit is a break of the wire electrode or soiling of the electrode. In the event of a break, the power supply for the apparatus is turned off, while in the latter case, a higher voltage is applied to the unit through a control procedure.

According to the present invention, the operation of the high-voltage system such as charging unit or transfer unit is monitored utilizing the output of an existing AIDC pattern sensor and giving attention to the feature of reversal development. Consequently, the invention realizes a high-voltage unit of reduced cost without the necessity of providing any special trouble detecting means for the unit and makes it possible to detect troubles or malfunctions other than the break of the wire electrode entailing short-circuiting, such as a reduction in the output of the high-voltage unit, a reduction in the charging voltage and impaired toner image transfer efficiency due to the soiling or damage of the wire electrode, a break or disconnection of the wire electrode causing no short-circuiting, and faults in the wiring extending from the high-voltage unit to the wire electrode (inclusive of faulty contact of the wire electrode connecting terminals).

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What we claim is:

1. An image forming apparatus comprising:

a photosensitive member;

means for charging the photosensitive member;

means for forming an electrostatic latent image on the photosensitive member charged by the charging means;

reversal development means for developing said latent image with a toner of the same polarity as the latent image;

means for transferring the toner image from the photosensitive member to a paper;

a sensing means for detecting the amount of the toner adhering to the photosensitive member or on the paper; and means for detecting a malfunction in the charging means or in the transferring means based on an output from the sensing means.

2. An image forming apparatus comprising:
a photosensitive member;
means for charging the photosensitive member;
means for forming an electrostatic image on the photosensitive member charged by the charging means;
reversal development means for developing said latent image with a toner of the same polarity as the latent image;
means for transferring the toner image from the photosensitive member to a paper;
a sensing means for detecting the amount of the toner present in the area of the photosensitive member on which the latent image is not formed;
means for comparing an output from the sensing means with a predetermined value; and
means for detecting a malfunction in the charging means based on an output from the comparing means.

3. An image forming apparatus as claimed in claim 2, wherein said sensing means is provided adjacent to the photosensitive member downstream of the transferring means, with respect to the direction of movement thereof.

4. An image forming apparatus comprising:
a photosensitive member;
means for charging the photosensitive member;
means for forming an electrostatic latent image on the photosensitive member charged by the charging means;
reversal development means for developing said latent image with a toner of the same polarity as the latent image;
means for transferring the toner image from the photosensitive member to a paper;
a sensing means for detecting the amount of the toner present in the area of the photosensitive member from which the toner image has been transferred to the paper;
means for comparing an output from the sensing means with a predetermined value; and
means for detecting a malfunction in the transferring means based on an output from the comparing means.

5. An image forming apparatus as claimed in claim 4, wherein said sensing means is provided adjacent to the photosensitive member downstream of the transferring means, with respect to the direction of movement thereof.

6. An image forming apparatus comprising:
a photosensitive member;
means for charging the photosensitive member;
means for forming an electrostatic latent image on the photosensitive member charged by the charging means;
reversal development means for developing said latent image with a toner of the same polarity as the latent image;
means for transferring the toner image from the photosensitive member to a paper;
a sensing means for detecting the amount of the toner present in the area of the paper on which the toner image is not transferred;
means for comparing an output from the sensing means with a predetermined value; and
means for detecting a malfunction in the charging means based on an output from the comparing means.

7. An image forming apparatus as claimed in claim 6, wherein said sensing means is provided adjacent to the paper downstream of the transferring means, with respect to the direction of movement of the paper.

8. An image forming apparatus comprising:
a photosensitive member;
means for charging the photosensitive member;
means for forming an electrostatic latent image on the photosensitive member charged by the charging means;
reversal development means for developing said latent image with a toner of the same polarity as the latent image;
means for transferring the toner image from the photosensitive member to a paper;
a sensing means for detecting the amount of the toner present in the area of the paper on which toner image has been transferred;
means for comparing an output from the sensing means with a predetermined value; and
means for detecting a malfunction in the transferring means based on an output from the comparing means.

9. An image forming apparatus as claimed in claim 8, wherein said sensing means is provided adjacent to the paper downstream of the transferring means, with respect to the direction of movement of the paper.

10. An image forming apparatus comprising:
a photosensitive member;
means for charging the photosensitive member;
means for forming an electrostatic latent image on the photosensitive member charged by the charging means;
reversal development means for developing said latent image with a toner of the same polarity as the latent image;
means for transferring the toner image from the photosensitive member to a paper;
a sensing means for detecting the amount of the toner adhering to the photosensitive member;
means for comparing an output from the sensing means with a predetermined value; and
means for detecting a malfunction in the charging means based on a first output signal from the comparing means and for detecting a malfunction in the transferring means based on a second output signal from the comparing means.

11. An image forming apparatus as claimed in claim 10, wherein
said first output signal is produced as a function of the amount of toner present on an area of the photosensitive member on which the latent image is not formed, and
said second output signal is produced as a function of the amount of toner present on an area of the phototsensitive member from which the latent image has been transferred to the paper.

12. An image forming apparatus comprising:
a photosensitive member;
means for charging the photosensitive member;
means for forming an electrostatic latent image on the photosensitive member charged by the charging means;

reversal development means for developing said latent image with a toner of the same polarity as the latent image;

means for transferring the toner image from the photosensitive member to a paper;

a sensing means for detecting the amount of the toner adhering to the paper;

means for comparing an output from the sensing means with a predetermined value; and means for detecting a malfunction in the charging means based on a first output signal from the comparing means, and for detecting a malfunction in the transferring means based on a second output signal from the comparing means.

13. An image forming apparatus as claimed in claim 12, wherein said first output signal is produced as a function of the amount of the toner present in the area of the paper on which the toner image is not transferred, and the second output signal is produced as a function of the amount of the toner present in the area of the paper on which the toner image has been transferred.

* * * * *